US007418389B2

(12) United States Patent
Chu et al.

(10) Patent No.: US 7,418,389 B2
(45) Date of Patent: Aug. 26, 2008

(54) DEFINING ATOM UNITS BETWEEN PHONE AND SYLLABLE FOR TTS SYSTEMS

(75) Inventors: Min Chu, Beijing (CH); Yong Zhao, Beijing (CH)

(73) Assignee: Microsoft Corporation, Redmond, WA (US)

( * ) Notice: Subject to any disclaimer, the term of this patent is extended or adjusted under 35 U.S.C. 154(b) by 640 days.

(21) Appl. No.: 11/033,075

(22) Filed: Jan. 11, 2005

(65) Prior Publication Data

US 2006/0155544 A1 Jul. 13, 2006

(51) Int. Cl.
*G10L 13/06* (2006.01)
*G10L 13/00* (2006.01)

(52) U.S. Cl. ..... 704/267; 740/260

(58) Field of Classification Search ..... 704/267, 704/260

See application file for complete search history.

(56) References Cited

U.S. PATENT DOCUMENTS 5,913,193 A * 6/1999 Huang et al. ..... 704/258
6,684,187 B1 * 1/2004 Conkie ..... 704/260
6,961,701 B2 * 11/2005 Ogawa et al. ..... 704/236

OTHER PUBLICATIONS

Guaus i Termens R; Sanz II, "Diphone-based unit selection for Catalan text-to-speech synthesis", 2000, Springer-Verlag, Berlin, Germany; vol. 1902 Text, speech and dialouge; third international workshop; University Ramon LLull, department de communicaciones & teoria.*

Breen et al., A. P., "A Phonologically Motivated Method of Selecting Non-Uniform Units", in ICSLP98, 1998.

Tyalor et al., P., "Speech Synthesis by Phonological Structure Matching", in Eurospeech 99, Budapest, Hungary, 1999.

Hunt et al., A., "Unit Selection in a Concatenative Speech Synthesis System Using a Large Speech Database", In Proc. ICASSP-96, Atlanta, Georgia, 1996.

* cited by examiner

*Primary Examiner*—Talivaldis Ivars Smits
*Assistant Examiner*—Josiah Hernandez
(74) *Attorney, Agent, or Firm*—Joseph R. Kelly; Westman, Champlin & Kelly, P.A.

(57) ABSTRACT

A method for identifying common multiphone units to add to a unit inventory for a text-to-speech generator is disclosed. The common multiphone units are units that are larger than a phone, but smaller than a syllable. The method slices each syllable into a plurality of slices. These slices are then sorted and the frequency of each slice is determined. Those slices whose frequencies exceed a threshold are added to the unit inventory. The remaining slices are decomposed according to a predetermined set of rules to determine if they contain slices that should be added to the unit inventory.

13 Claims, 7 Drawing Sheets

DEFINING ATOM UNITS BETWEEN PHONE AND SYLLABLE FOR TTS SYSTEMS

BACKGROUND OF THE INVENTION

The present invention deals with speech properties. More specifically, the present invention deals with unit inventories in text-to-speech systems.

Speech signal generators or synthesizers in a text-to-speech (TTS) system can be classified into three distinct categories: articulatory synthesizers; formant synthesizers; and concatenative synthesizers. Articulatory synthesizers are based on the physics of sound generation in the vocal apparatus. Individual parameters related to the position and movement of vocal chords are provided. The sound generated therefrom is determined according to physics. In view of the complexity of the physics, practical applications of this type of synthesizer are considered to be far off.

Formant synthesizers do not use equations of physics to generate speech, but rather, model acoustic features or the spectra of the speech signal, and use a set of rules to generate speech. In a formant synthesizer, a phoneme is modeled with formants wherein each formant has a distinct frequency "trajectory" and a distinct bandwidth which varies over the duration of the phoneme. An audio signal is synthesized by using the frequency and bandwidth trajectories to control a formant synthesizer. While the formant synthesizer can achieve high intelligibility, its "naturalness" is typically low, since it is very difficult to accurately describe the process of speech generation in a set of rules. In some systems, in order to mimic natural speech, the synthetic pronunciation of each phoneme is determined by a set of rules which analyzes the phonetic context of the phoneme. U.S. Pat. No. 4,979,216 issued to Malsheen et al. describes a text-to-speech synthesis system and method using context dependent vowel allophones.

Concatenation systems and methods for generating text-to-speech operate under an entirely different principle. Concatenative synthesis uses pre-recorded actual speech forming a large database or corpus. The corpus is segmented based on phonological features of a language. Commonly, the phonological features include transitions from one phoneme to at least one other phoneme. For instance, the phonemes can be segmented into diphone units, syllables or even words. Diphone concatenation systems are particularly prominent. A diphone is an acoustic unit which extends from the middle of one phoneme to the middle of the next phoneme. In other words, the diphone includes the transition between each partial phoneme. It is believed that synthesis using concatenation of diphones provides good voice quality since each diphone is concatenated with adjoining diphones where the beginning and the ending phonemes have reached steady state, and since each diphone records the actual transition from phoneme to phoneme.

In a concatenative Text-to-speech (TTS) system, speech output is generated by concatenating small pre-stored speech segments one by one. Most state-of-the-art TTS systems adopt corpus-driven approaches, called unit selection, due to their capability to generate highly natural speech. In these systems, a set of "atom units", that is the smallest constituents in the concatenation procedure that could not be segmented further are defined. Typically there are many instances with phonetic and prosodic variations for the units that are kept in a very large unit inventory, and a unit selection algorithm is used to select the most suitable unit sequence by minimizing a cost function.

Defining a suitable set of atom units is very important for such systems. There is always a balance between two conflicting requirements for the unit inventory. On the one hand, in order to get natural prosody, smaller units are preferred so that a pre-recorded unit inventory could cover as many prosodic variations of each unit as possible. On the other hand, in order to make concatenated utterances smooth, larger units are preferred because they reduce the likelihood of an unsmooth concatenation in the synthesized utterances. Strategies for defining the atom unit differ among languages due to the different phonological characteristics of languages. For languages that have a relatively small syllable set, such as Chinese, which contains less than 2000 syllables, syllables are often used as the atom units. However, using syllables as atom units becomes somewhat impractical for languages that have too many syllables to enumerate effectively. For example, English contains more than 20,000 possible syllables. This makes it difficult to generate a closed list of syllables for English. In such a language, smaller atom units such as the phoneme, diphone or the mixture of the two is often adopted. However, using such small units has many shortcomings.

Using smaller units means more units per utterance and more instances per unit. That is a much larger search space for unit selection and more search time is required during speech generation.

Smaller units also cause more difficulties in precise unit segmentation. This is crucial for speech quality of synthesized speech. For example, in English, the word 'yes' consists of three phones, /j/, /e/ and /s/, where the boundary between /e/ and /s/ can be labeled easily, yet it is difficult to separate /j/ from /e/ due to the flat transition between their formant tracks. Moreover, experimentation shows that if the co-articulation between two phones is strong, it is difficult to smoothly concatenate two segments selected from different locations during the synthesis phase.

Therefore, it has been desired for a method to define a set of atom units having a size between phone and syllable to increase the overall efficiency of the text to speech system in large syllable languages such as English

SUMMARY OF THE INVENTION

One embodiment of the present invention is directed towards a method for defining a set of atom units for use in the unit inventory of a text-to-speech synthesizer.

A spoken text along with a phonetic transcription of the text is received. Then a list of monophones for the target language is obtained. These monophones form the basis of the unit inventory for the language and the speaker. Next the method identifies a set of common multiphones for the language. These common multiphones form the atom units for the language and are sized between a phone and a syllable. These common multiphones are then added to the unit inventory for the target language. The atom units are of varying sizes, and are not merely diphones, triphones, or quinphones as used in previous systems.

In determining the common multiphones to add to the unit inventory, the present invention uses an expanded nucleus slice for each syllable in the lexicon. The expanded nucleus slice is between a phone and a full syllable. In one embodiment the common multiphones that are selected are those multiphones, whose frequency of occurrence in the training data exceeds a threshold value. The common multiphones are then added to the unit inventory.

The remaining multiphones are considered non-common. The non-common multiphones are decomposed according to a set of rules until a sequence that is composed of one of the common multiphones and several monophones at its margin, or a list of monophones is identified. If the non-common multiphone cannot be decomposed to match either a sequence that is composed of one of the common multiphones and several monophones at its margin, or a list of monophones, it is added to the unit inventory. If the decomposed slice is matched with an entry in the unit inventory, the process of decomposing is stopped.

During the process of decomposition, any phones that are removed from the slice are added to the adjoining slice. The newly formed slices are then decomposed to determine if the newly formed slice should be included in the unit inventory.

DETAILED DESCRIPTION OF ILLUSTRATIVE EMBODIMENTS

Figure 1:
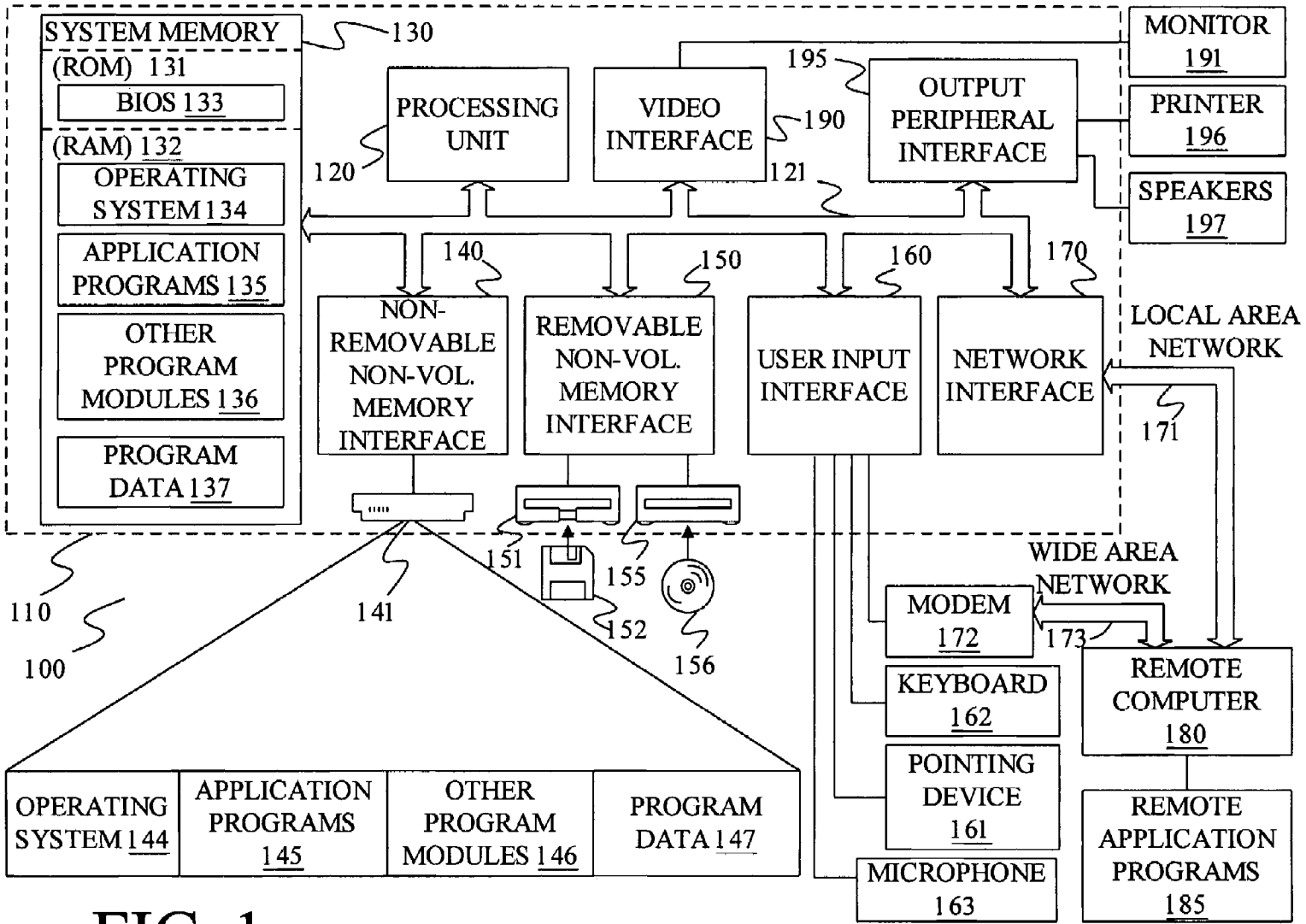
FIG. 1 is a block diagram of one exemplary environment in which the present invention can be used.

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices.

With reference to FIG. 1, an exemplary system for implementing the invention includes a general purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 195.

The computer 110 may operate in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
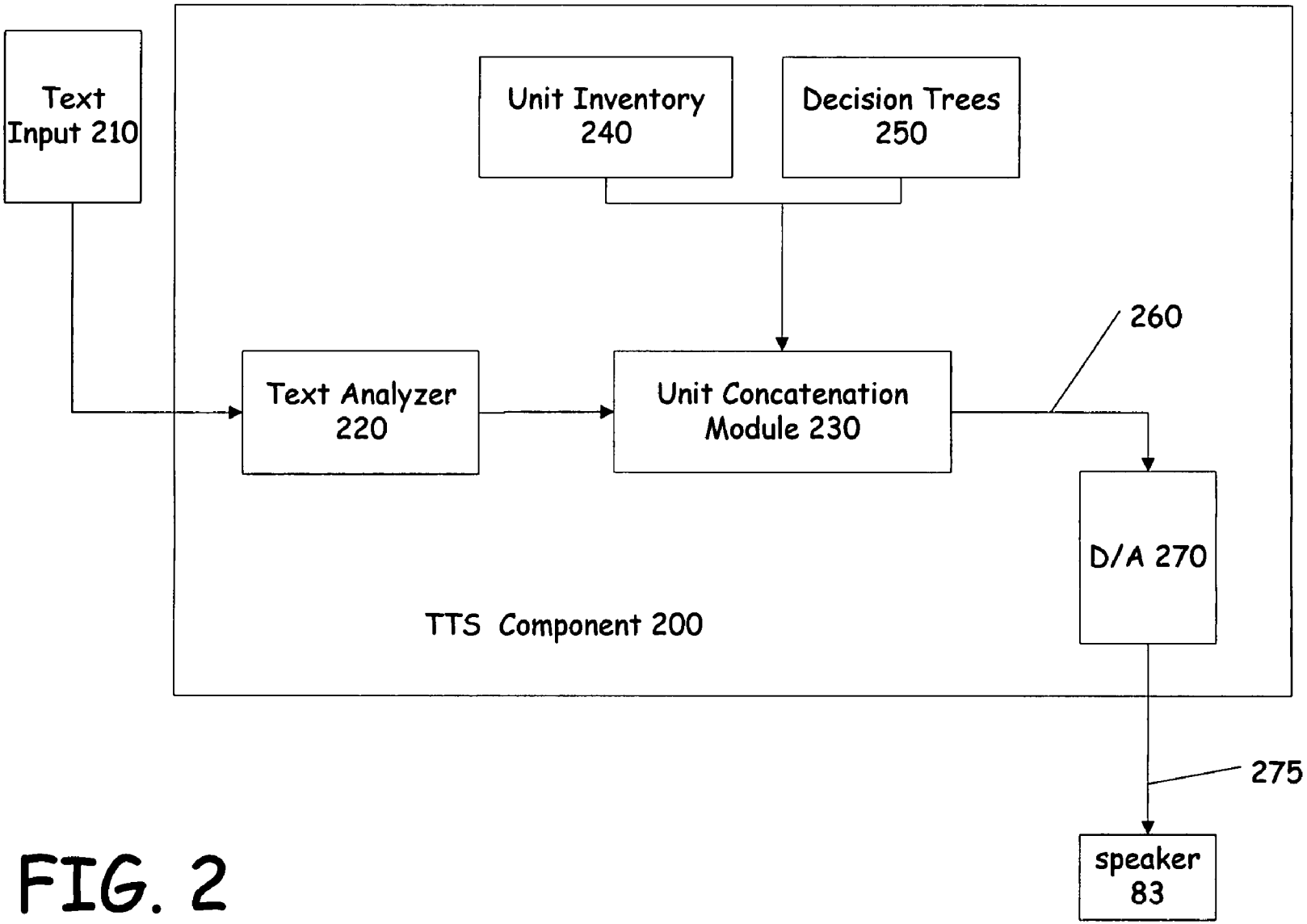
FIG. 2 is a block diagram illustrating the components of a text-to-speech engine that can be used with the present invention.

An exemplary text-to-speech synthesizer 200 is illustrated in FIG. 2. However, other text-to-speech synthesizers or letter to sound components can be used. Generally, the text-to-speech synthesizer 200 includes a text analyzer 220 and a unit concatenation module 230. Text to be converted into synthetic speech is provided as an input 210 to the text analyzer 220. The text analyzer 220 performs text normalization, which can include expanding abbreviations to their formal forms as well as expanding numbers, monetary amounts, punctuation and other non-alphabetic characters into their full word equivalents. The text analyzer 220 then converts the normalized text input to a string of sub-word elements, such as phonemes, by known techniques. The string of phonemes is then provided to the unit concatenation module 230. If desired, the text analyzer 220 can assign accentual parameters and breaking indices to the string of phonemes using prosodic templates (not illustrated).

The unit concatenation module 230 receives the phoneme string and constructs corresponding synthetic speech, which is provided as an output signal 260 to a digital-to-analog converter 270, which in turn, provides an analog signal 275 to the speaker 83.

Based on the string input from the text analyzer 220, the unit concatenation module 230 selects representative instances from a unit inventory 240 after working through corresponding decision trees stored at 250. The unit inventory 240 is a store of representative context-dependent phoneme-based units of actual acoustic data. In one embodiment, triphones (a phoneme with its one immediately preceding and succeeding phonemes as the context) are used for the context-dependent phoneme-based units. Other forms of phoneme-based units include quinphones and diphones or other n-phones. The decision trees 250 are accessed to determine which acoustic instance of a phoneme-based unit is to be used by the unit concatenation module 230. In one embodiment, the phoneme-based unit is one phoneme so a total of 45 phoneme decision trees are created and stored at 250. However, other numbers of phoneme decision trees can be used.

The decision tree 250 is illustratively a binary tree that is grown by splitting a root node and each of a succession of nodes with a linguistic question associated with each node, for instance, a question asking about the category of the left (preceding) or right (following) phoneme. The linguistic questions about a phoneme's left or right context are usually generated by an expert in linguistics in a design to capture linguistic classes of contextual affects. In one embodiment, Hidden Markov Models (HMMs) are created for each unique context-dependent phoneme-based unit. One illustrative example of creating the unit inventory 240 and the decision trees 250 is provided in U.S. Pat. No. 6,163,769 entitled "TEXT-TO-SPEECH USING CLUSTERED CONTEXT-DEPENDENT PHONEME-BASED UNITS", which is assigned to the same assignee as the present application. However, other methods can be used.

As stated above, the unit concatenation module 230 selects the representative instance from the unit inventory 240 after working through the decision trees 250. During run time, the unit concatenation module 230 can either concatenate the best preselected phoneme-based unit or dynamically select the best phoneme-based unit available from a plurality of instances that minimizes a joint distortion function. In one embodiment, the joint distortion function is a combination of HMM score, phoneme-based unit concatenation distortion and prosody mismatch distortion.

The text-to-speech synthesizer 200 can be embodied in the computer 50 wherein the text analyzer 220 and the unit concatenation module 230 are hardware or software modules, and where the unit inventory 240 and the decision trees 250 can be stored using any of the storage devices described with respect to computer 50. As appreciated by those skilled in the art, other forms of text-to-speech synthesizers can be used. Besides the concatenative synthesizer 200 described above, articulator synthesizers and formant synthesizers can also be used to provide audio proofreading feedback.

Figure 3:
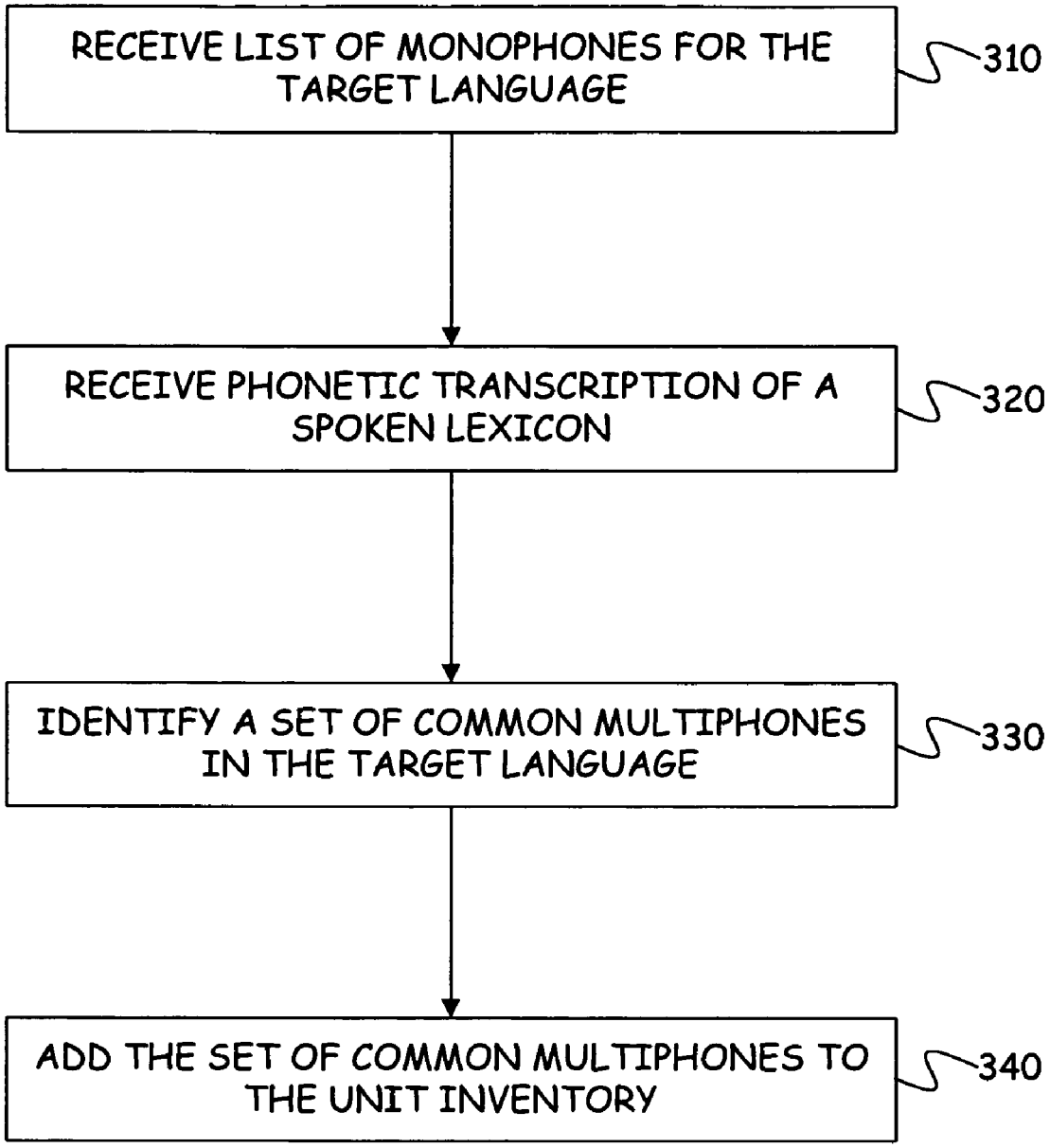
FIG. 3 is a flow diagram illustrating the steps that are executed to generate the unit inventory.

FIG. 3 is a flow diagram illustrating the steps that are executed by the present invention to generate the unit inventory for the text-to-speech synthesizer 200 according to one embodiment of the present invention. First the general process of the present invention will be presented and then a more detailed description of the processes executed at some of the steps will be discussed.

The first step of the process is to receive or identify a complete list of monophones for the target language. This is illustrated at step 310. The target language can be any spoken language, such as Chinese, English, French, German, Hindi, Italian, Japanese or Spanish. Next, a spoken lexicon or speech corpus in the target language is received. The lexicon provided includes a phonetic transcription for each of the words that comprise the lexicon. This is illustrated at step 320. However, it should be noted that the order of steps 310 and 320 can be reversed.

Once the speech lexicon and monophones are received a set of common multiphone units are identified. Common multiphone units are units that are sized between a phone and a syllable. This is illustrated at step 330. The identified common multiphones are then added to the unit inventory for the target language. This is illustrated at step 340.

Figure 4:
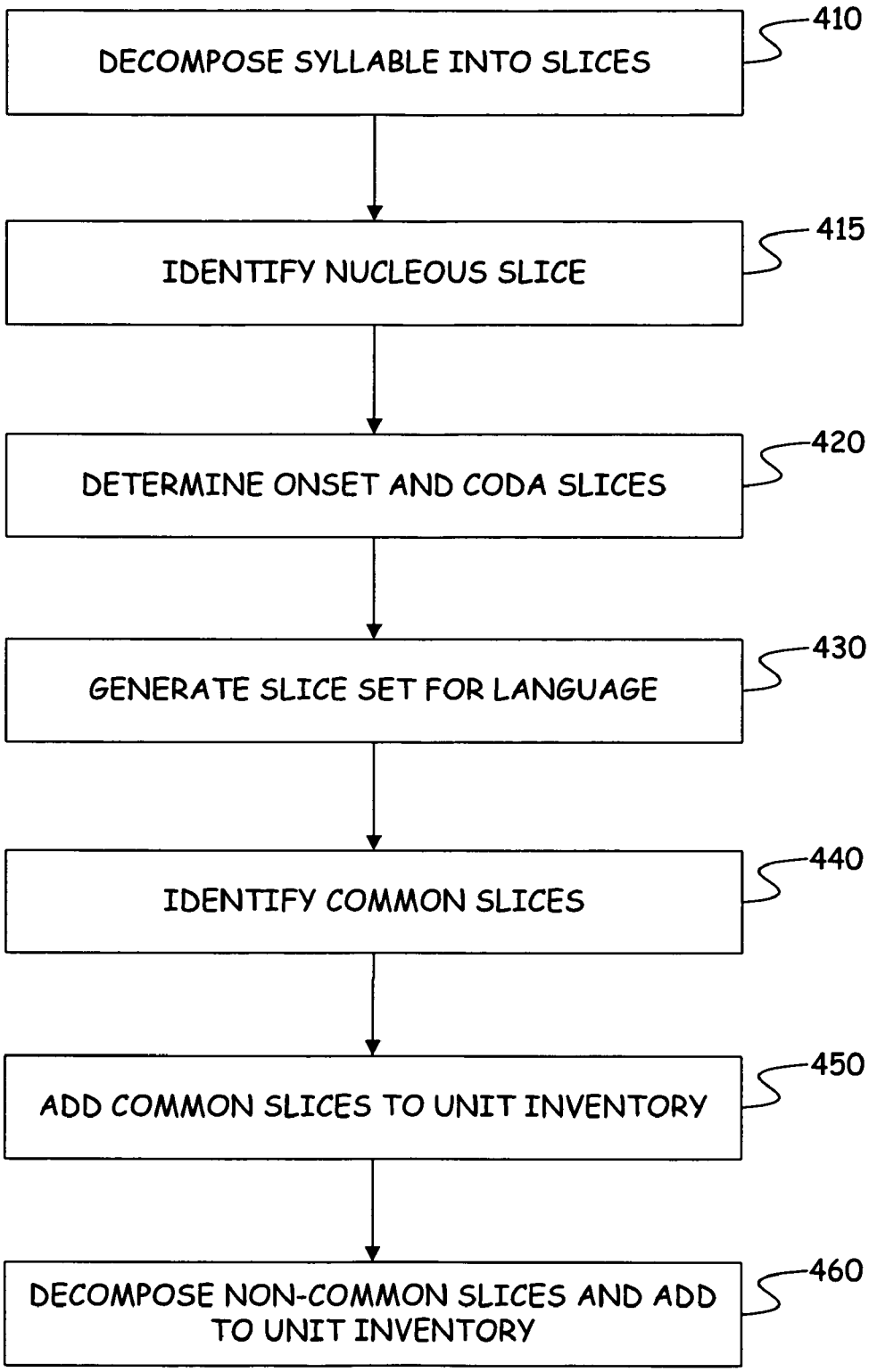
FIG. 4 is a flow diagram illustrating the steps in identifying common multiphone units to add to the unit inventory

FIG. 4 is a flow diagram illustrating the steps executed in identifying a set of common multiphone units to add to the unit inventory at step 330 of FIG. 3.

The first step in identifying the common multiphone units is to decompose each syllable contained in the lexicon into a plurality of slices. This is illustrated at step 410. In one embodiment the syllable is broken down into three slices. However, other numbers of slices can be used. For purposes of this discussion these slices are referred to as an onset slice, a nucleus slice, and a coda slice.

Figure 5A:
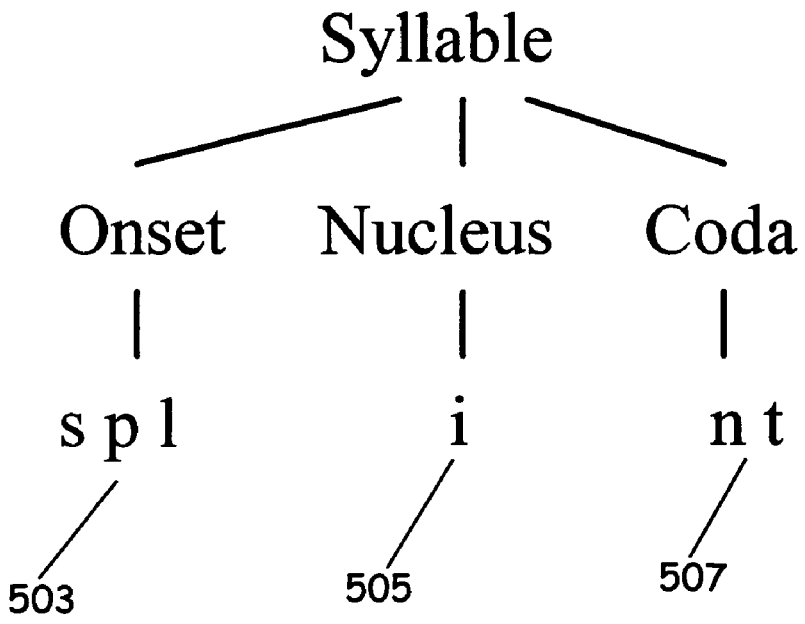
FIG. 5A is a phonetic breakdown of a word using traditional phonology view of syllable structure.
Figure 5B:
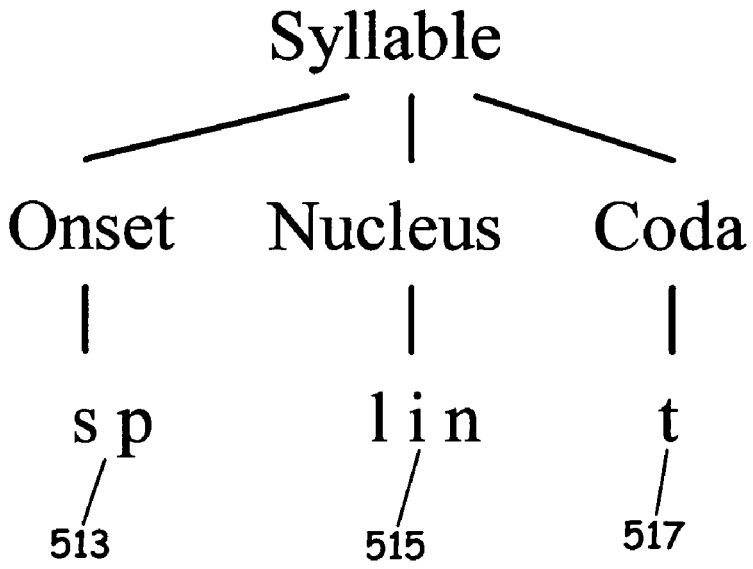
FIG. 5B is a phonetic breakdown of the word of 5A incorporating an enlarged nucleus of the present invention.

FIG. 5A illustrates the traditional phonology view of syllable structure for the word "splint". That is, within a given syllable, the vowel forms the nucleus 505, and any consonants preceding the vowel form the onset 503 and any consonant following the nucleus forms the coda 507. In present invention, the domain of nucleus slice 505 in FIG. 5A is enlarged. FIG. 5B illustrates the phonological view of a syllable for the word "splint" according to the present invention. In this view the vowel and all sonorants around it form the nucleus slice 515.

This view provides better results as co-articulation between vowels and other sonorants are typically strong while the boundaries between such phonemes are often difficult to determine. By grouping the vowel and surrounding sonorants into the same unit, the unit segmentation problem is generally easier to manage, and the likelihood of generating an unsmooth concatenation for the syllable is reduced. The formation of the nucleus slice is illustrated at step 415.

Once the nucleus slice is determined at step 415, the onset and coda slices for the syllable are determined at step 420. At this step all consonants in the syllable occurring before the nucleus slice 515 form the onset slice 513 and all consonants occurring after the nucleus slice 515 form the coda slice 517. However, other methods for generating a slice can be used. While the present invention discusses three slices, only the nucleus slice is needed as all syllables have a nucleus, but may not have a coda slice such as in "shoe", or may not have an onset slice such as in "eight".

The next step is to generate an initial slice set for the target language. This is illustrated at step 430. In order to generate a full list of possible slices for the target language, a lexicon containing word entries with pronunciations in that language is needed. This lexicon corresponds to the lexicon obtained at step 320 in FIG. 3. However, in alternative embodiments the lexicon can be obtained at this time.

Table 1 illustrates an example of a portion of an English lexicon which can be used by the present invention. All of syllables in the lexicon are decomposed into one to three slices according to the list of phonemes received at step 310 in FIG. 3 and phonological view on syllable constitution as illustrated in FIG. 5B. Then, a list of initial slices is generated, by enumerating slices in the lexicon.

TABLE 1

Examples for English lexicon entries. The field Pronunciation is word pronunciation, and the field UnitSequence is the slice sequence corresponding to the immediately above pronunciation. The symbol '.' denotes the slice boundary, and the number 1 represents a stress.

| | |
|---|---|
| Word | mistake |
| Pronunciation0 | m ih - s t ey 1 k |
| UnitSequence | m ih - s t . ey 1 . k |
| POS0 | noun |
| POS1 | verb |
| Word | abides |
| Pronunciation0 | ax - b ay 1 d z |
| UnitSequence | ax - b . ay 1 . d z |
| POS0 | verb |

Once the lexicon has been decomposed into slices, a set of common slices is identified. This is illustrated at step 440. The common slices not already in the unit inventory, based on the obtained list of phones are added to the unit inventory at step 450. The present invention then decomposes the non-common slices according to a set of rules until a sequence that is composed of one of the common multiphones and several monophones at its margin, or a list of monophonesis identified. This is illustrated at step 460. Non-common slices are only added to the unit inventory if it is not possible to decompose the slice into an atom unit that matches an atom unit already in the unit inventory either as a phone or common multiphone slice. The process of adding slices or atom units to the unit inventory is discussed in greater detail with respect to FIG. 6.

Figure 6:
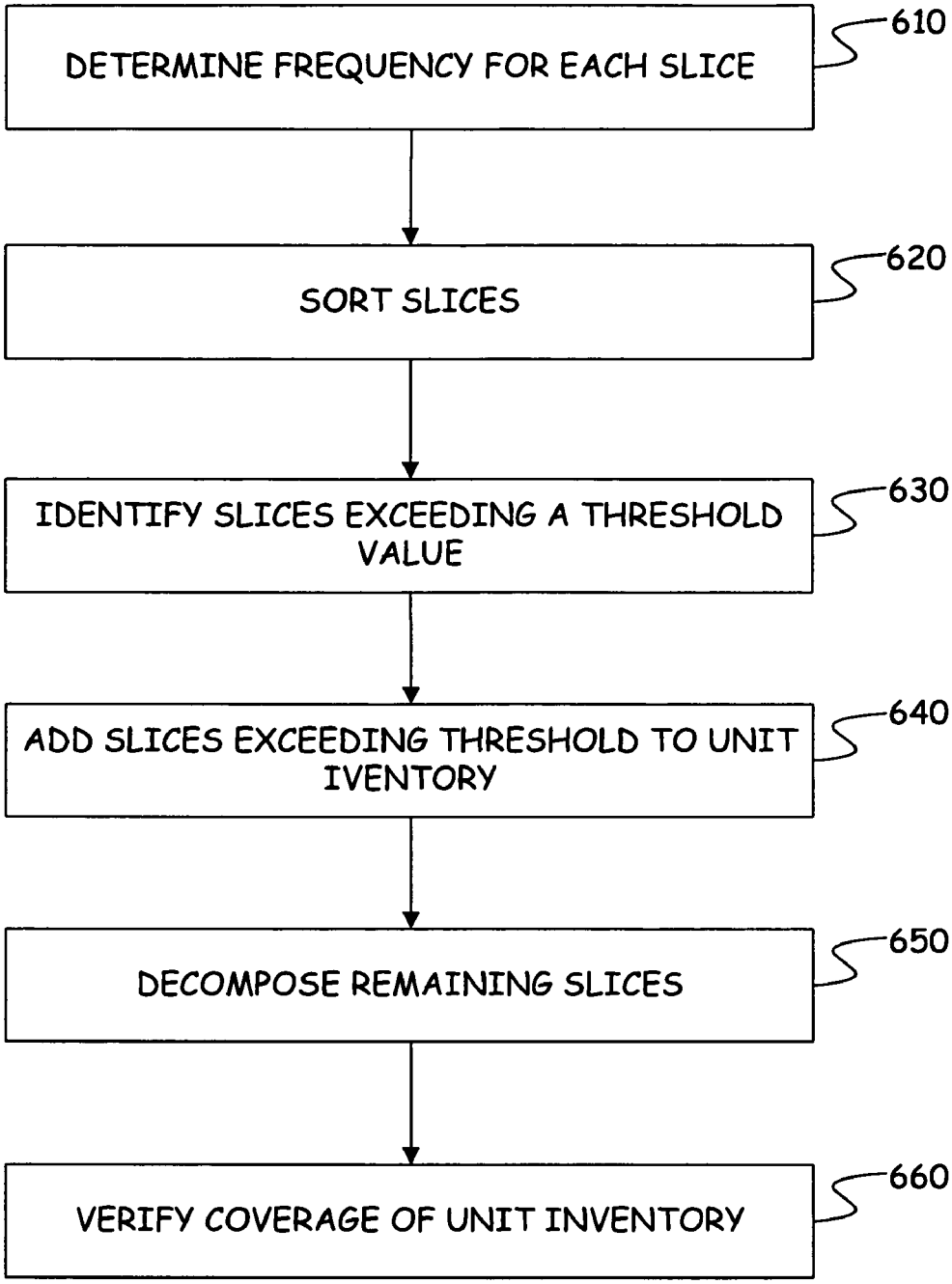
FIG. 6 is a flow diagram illustrating the steps for decomposing non-common slices according to the present invention.

FIG. 6 is a flow diagram illustrating the process of decomposing non-common slices according to a predetermined set of rules for the target language. For purposes of this discussion the rules are based on the English language. However, those skilled in the art will recognize that other languages and rules could be used for this decomposition process.

In an ideal environment where storage size of the unit inventory is not an issue it is desirable to use the slice set developed at step 430 as the atom unit set for the unit inventory. However, it has been found that some slices in the set have very low frequency and provide very little to the overall unit inventory. In other words, these slices are those that are found in infrequently used words or words that are not native to the target language. To increase the efficiency of the unit inventory, these non-common slices should not be treated as a single unit. Therefore, the present invention takes these non-common slices and breaks the slices into smaller slices.

This process is also called decomposition of the slice. However, the non-common slices must first be identified.

In order to identify the non-common slices the present invention determines the frequency of each slice in the set of initial slices. This is illustrated at step 610. In one embodiment the slice's frequency is equal to the total number of words in the speech corpus or lexicon having the slice. However, as the slice set is used as a portion of the atom units in the unit inventory it is desirable to verify that each slice has appeared enough times in the speech corpus or lexicon prior to adding the slice to the unit inventory. Therefore, in one embodiment the present invention takes into account the frequency of the word in the speech corpus.

Next the slices are sorted based on the frequency or number of occurrences of the slice in the speech corpus. By sorting the slices in the initial list in the order of frequencies it is often the case that distribution of the slices is uneven. That is some slices occur much more frequently than others. For example, in English, the cumulative frequency of the top 50% of the slices represents as many as 99% of the total occurrences of all slices in the speech corpus. The sorting of the slices is illustrated as step 620.

Once the slices have been sorted in the order determined above at step 620, the present invention identifies those slices whose frequency of occurrence exceeds a threshold value. This is illustrated at step 630. Depending on the configuration of the system the threshold value can be set differently. In one embodiment those slices that occur more than a set number of times, such as 12, are considered common slices. In another embodiment those slices that represent a set percentage of the total slices are considered common. Typically in this situation, the percentage will be significantly less than one percent. Those slices identified as common are added to the unit inventory at step 640.

Next the non-common slices are decomposed into a sequence of a common slice plus monophones or a sequence of monophones. There are several methods that can be used to decompose noncommon slices. One method is to construct a look-up table to map the decomposing operations. A second method could split the slices into phones. However, in one embodiment of the present invention a rule-based method, which combines the statistics over the corpus script and human prior phonology knowledge, is used. The basic idea behind this method is to re-compose the odd target phone cluster with a core slice plus other marginal mono-phones. In other words, the present invention determines how to truncate a phone cluster based on its heading or tailing phone, according to a set of truncating priority rules, until a residual set of the phone cluster is covered by the defined slice set, or no further truncation can occur. One example of the truncation is discussed with respect to FIG. 7 below.

The first step in this process is the decomposition of nucleus slices. The format of a nucleus slice can be represented as:

[sonorant consonant cluster] xx [sonorant consonant cluster]

where "xx" denotes a vowel in the nucleus. As discussed above, some non-common nucleus slices should be truncated into a core nucleus slice plus other marginal mono-phones as illustrated below:

[sonorant *] core nucleus slice [sonorant *]

For the nuclei outlying the core nucleus slice set, the slice is truncated on its heading or tailing phone, according to a set of truncating priority rules, until the residual is covered by the core nucleus slice set. In one embodiment the truncating priority is based on the phonetic and phonologic knowledge of the language. However, other truncation processes can be used. This process does not guarantee uniformity for all languages, but provides sufficient coverage for the language.

Figure 7:
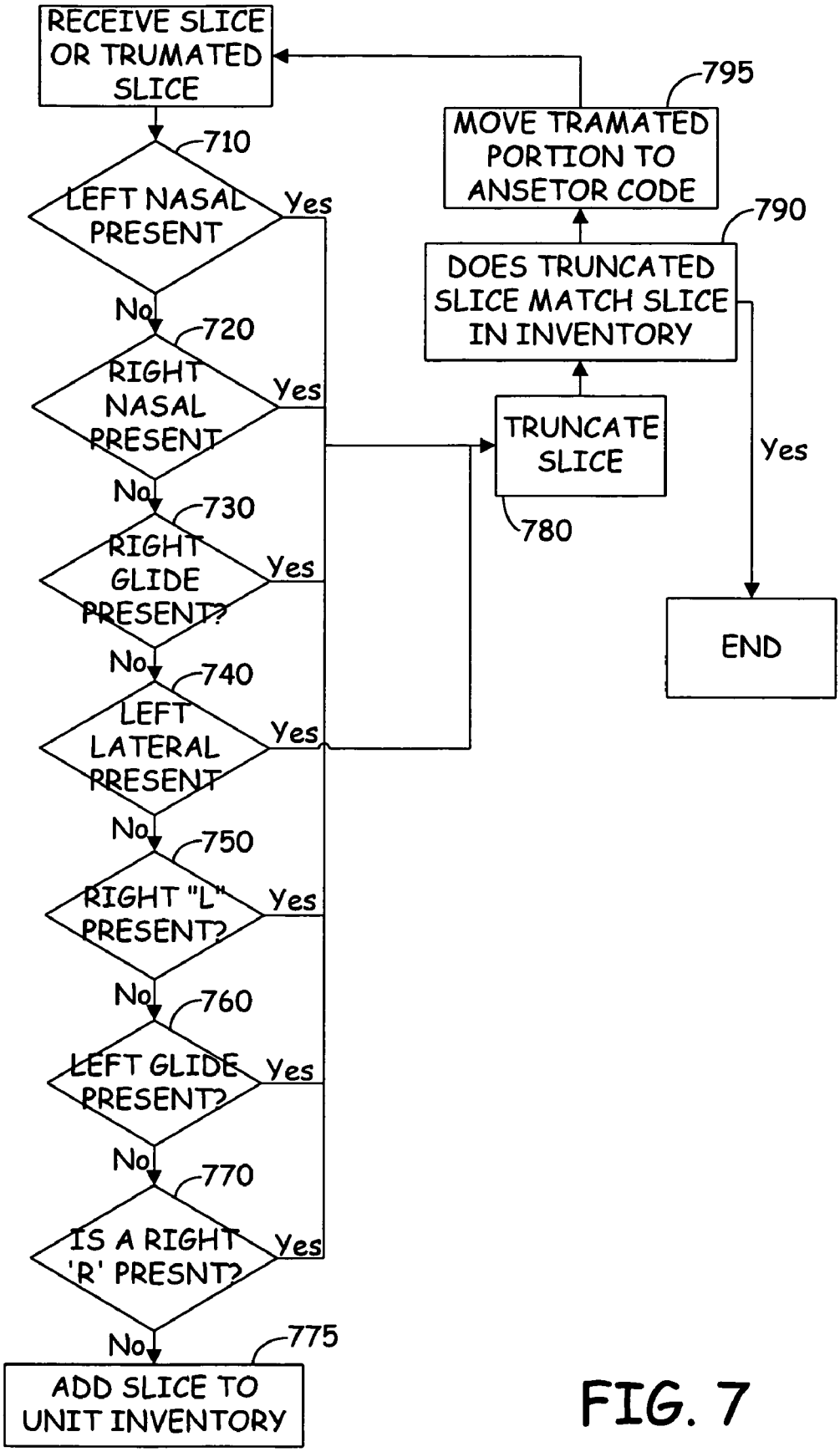
FIG. 7 is a flow diagram illustrating the steps associated with a rule for truncating a non-common atom unit.

FIG. 7 is a flow diagram illustrating the rules for truncating a slice for English according to one embodiment of the present invention. However, those skilled in the art will recognize that other truncating rules can be used.

The first step in the exemplary truncation rules is to determine if a left nasal such as [m n ng] is present in the slice. This is illustrated at step 710. If the left nasal is present the system truncates the nasal off of the slice. If the nasal is not present the system determines if a right nasal, such as [m n ng] is present in the slice. This is illustrated at step 720. If the right nasal is present the system truncates the right nasal from the slice.

If the right nasal is not present the system determines if a right glide, such as [y w], is present in the slice. This is illustrated at step 730. If the right glide is present the system removes the glide from the slice. If the right glide is not present in the slice the system determines if the slice contains a left lateral, such as [l r]. This is illustrated at step 740. If the left lateral is present in the slice the left lateral is removed from the slice.

If a left lateral is not present in the slice the system determines if there is a right "l" sound present in the slices. This is illustrated at step 750. If the right "l" sound is present in the slice, it is removed from the slice. If the right "l" is not present in the slice the system determines if there is a left glide, such as [y w], present in the slice. This is illustrated at step 760. If a left glide is present it is removed from the slice.

If a left glide is not present in the slice the system determines if there is a right "r" present in the slice. This is illustrated at step 770. If there is a right "r" present in the slice, it is removed from the slice. If the system process through the entire list of rules for truncating the slice, the slice can according to one embodiment be added to the unit inventory at step 775.

The truncation of the slice is illustrated at step 780. At this step the phone that was identified in the rules is removed from the slice, and the remaining slice is reformed. Next the remaining phone cluster is compared against the slices in the unit inventory. This is illustrated at step 790. If the new phone cluster is not present in the unit inventory, the truncation process will be repeated until the remaining phone cluster is either matched with a cluster in the unit inventory or the system completes all of the truncating rules. The portion of the phone cluster that is removed from the slice is treated as a either a new onset or new coda slice. In an alternative embodiment the removed phones are added to the adjoining onset or coda slice. This is illustrated at step 795.

Since the set of nucleus slices is changed, and the onset and coda slices are regenerated it is necessary to decompose these slices as well. In a process similar to the process illustrated above for the nucleus slice, only high frequency slices in the onset and coda slice sets are kept as a single unit, others are truncated. For example in English, only some high frequency consonant clusters in onset part such as /st/, /sp/, /st/ are treated as one slice, all others are split into mono-phones. This is illustrated as step 650 of FIG. 6.

The final step of the process is to verify the coverage of the slice set. This is illustrated at step 660. At this step the process determines that any syllables present in the language should be able to be formed by slices or their combinations in the unit inventory. This is especially important for those syllables that do not appear in the speech corpus that was used for counting the frequencies of occurrences. Therefore it is desirable that the set of atom units in the unit inventory includes all monophones for the target language. Many onset, nucleus and coda are mono-phones as well as the marginal truncated mono-phones thus making this test an easy one. If all of the mono-phones for the language are not present in the unit inventory, the frequency threshold for the three types of slices can be increased respectively until all monophones for the language are included in the unit inventory.

Although the present invention has been described with reference to particular embodiments, workers skilled in the art will recognize that changes may be made in form and detail without departing from the spirit and scope of the invention.

What is claimed is:

1. A method of developing a unit inventory for use by a text to speech system, comprising:

identifying a list of phones for a target language;

receiving a lexicon containing phonetic transcriptions of a plurality of words having a plurality of syllables;

identifying a set of common multi-phone atom units for the lexicon by:

decomposing each syllable into a plurality of slices;

identifying non-common slices within the plurality of slices; and decomposing the non-common slices according to predetermined set of rules;

adding the set of common multi-phone atom units to the unit inventory for the target language; and wherein if the predetermined rules are unable to decompose the non-common slice, then:

adding the slice to the unit inventory.

2. The method of claim 1 wherein identifying the non-common slices within the plurality of slices comprises:

sorting the plurality of slices in order of frequency of occurrence;

selecting as the non-common slices those slices in the plurality of slices having a frequency of occurrence in the lexicon below a threshold value.

3. The method of claim 2 wherein the threshold value is 12.

4. The method of claim 1 wherein decomposing the non-common slices comprises:

removing at least one phone from the non-common slice to generate a first new slice; and determining if the first new slice matches one of an existing phone or common multi-phone in the unit inventory.

5. The method of claim 4 wherein if the first new slice does not match with an existing phone or common multi-phone in the unit inventory further executing the steps of:

decomposing the first new slice according the predetermined set of rules to generate a second new slice;

determining if the second new slice is the same as the first new slice;

if the second new slice is the same as the first new slice, then:

adding the second new slice to the unit inventory;

if the second new slice is not the same as the first new slice, then:

determining whether the second new slice matches one of the existing phones or common multi-phones in the lexicon; and if the second new slice does not match one of the existing phones or common multi-phones in the lexicon, then:

repeating the decomposing step.

6. The method of claim 4 further comprising: after removing the phone from the slice, adding the removed phone to a neighboring slice.

7. The method of claim 1 wherein decomposing the syllable into a plurality of slices comprises: breaking the syllable into three slices.

8. The method of claim 7 wherein the three slices represent an onset slice, a nucleus slice and a coda slice, and wherein at least one of the three slices is a multiphone slice that is sized between a phone and a syllable.

9. The method of claim 1 wherein the predetermined rules are based upon phonetic and phonological statistics for the target language.

10. An apparatus for generating speech from text, comprising:

a unit inventory for storing a set of phoneme based atom units for at least one Target speaker, said set of phoneme based atom units being a plurality of different sizes and including only units limited to sizes greater than a phone but less than a syllable;

a text analyzer for obtaining a string of phonetic symbols representative of a text to be converted to speech; and a concatenation module for selecting stored phoneme-based atom units to generate speech corresponding to the text, wherein the set of atom units comprises atom units that are determined to be common multi-phonal units for the target language;

wherein the set of atom units includes atom units that are not common to the target language, but were unable to be decomposed according to a predetermined set of rules to match an entry already in the unit inventory.

11. The apparatus of claim 10 wherein the set of phoneme-based atom units includes a complete set of monophones for the target language.

12. The apparatus of claim 10 wherein the set of phoneme-based atom units sized between a phone and a syllable are representative of common multiphone units in the target language.

13. A unit inventory for use in text-to-speech generation, comprising:

a set of monophone units for a target language;

a set of atom units sized between a phone and a syllable, for the target language;

wherein the set of atom units comprises atom units that are determined to be common multiphonal units for the target language;

wherein the set of atom units includes atom units that are not common to the target language, but were unable to be decomposed according to a predetermined set of rules to match an entry already in the unit inventory.

* * * * *